US007880107B1

(12) United States Patent
Srbinovski et al.

(10) Patent No.: US 7,880,107 B1
(45) Date of Patent: Feb. 1, 2011

(54) MOMENTARY PUSH BUTTON SWITCH

(75) Inventors: Igorce Srbinovski, Harbor City, CA (US); Michael D. Tittle, Harbor City, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 163 days.

(21) Appl. No.: 11/974,440

(22) Filed: Oct. 12, 2007

(51) Int. Cl.
*H01H 5/18* (2006.01)

(52) U.S. Cl. ..... 200/406

(58) Field of Classification Search ..... 200/406, 200/341, 342, 345, 511, 517, 520, 521, 516, 200/513

See application file for complete search history.

(56) References Cited

U.S. PATENT DOCUMENTS

| | | | | |
|---|---|---|---|---|
| 2,355,459 | A | 8/1944 | Miskella | |
| 2,422,097 | A | 6/1947 | Hansen | |
| 2,478,564 | A | 8/1949 | Bordelon | |
| 2,966,561 | A | 12/1960 | Durant | |
| 3,012,219 | A | 12/1961 | Levin et al. | |
| 3,204,067 | A | 8/1965 | Brown | |
| 3,226,991 | A | 1/1966 | Hartsock | |
| 3,329,784 | A | 7/1967 | Rogero | |
| 3,445,796 | A | 5/1969 | Spiroch et al. | |
| 3,454,733 | A | 7/1969 | Sanford et al. | |
| 3,463,491 | A | 8/1969 | Shaw | |
| 3,472,721 | A | 10/1969 | Abramson et al. | |
| 3,509,317 | A | 4/1970 | Valsamakis et al. | |
| 3,510,069 | A | 5/1970 | Hannum | |
| 3,523,168 | A | 8/1970 | Holmes | |
| 3,535,478 | A | 10/1970 | Lewis | |
| 3,588,425 | A | 6/1971 | Erickson | |
| 3,591,747 | A | 7/1971 | Dennison | |
| 3,592,992 | A | 7/1971 | Costello | |
| 3,598,948 | A | 8/1971 | Bowen et al. | |
| 3,600,553 | A | 8/1971 | Costello | |
| 3,624,330 | A * | 11/1971 | Bognar et al. | 200/534 |
| 3,649,811 | A | 3/1972 | Schoenthaler | |
| 3,657,508 | A | 4/1972 | Studnick | |

(Continued)

FOREIGN PATENT DOCUMENTS

| | | |
|---|---|---|
| FR | 1362299 | 9/1964 |

(Continued)

OTHER PUBLICATIONS

Judco Manufacturing drawings (redacted) of prior switch assembly on sale at least as early as 2002 (4 sheets).

(Continued)

*Primary Examiner*—Edwin A. Leon
(74) *Attorney, Agent, or Firm*—Michael Zarrabian, Esq.; Myers Andras Sherman & Zarrabian LLP

(57) ABSTRACT

A switch device includes a contact member and a plunger that removably connects to the contact member. The contact member creates a first audible feedback sound in response to being placed in a first electrical state. Additionally, a switch device includes a compressible contact member including at least one removable electrical contact portion, and a movable member that removably connects to a center portion of the compressible contact member. The compressible contact member creates a first audible feedback sound in response to being placed in a compressed state by the moveable member and creates a second audible feedback sound in response to being uncompressed.

21 Claims, 20 Drawing Sheets

U.S. PATENT DOCUMENTS 3,668,579 A 6/1972 Harman
3,674,974 A 7/1972 Costello
3,674,975 A 7/1972 Nugent et al.
3,694,603 A 9/1972 Congelliere et al.
3,744,557 A 7/1973 Costello
3,760,312 A 9/1973 Shlesinger, Jr.
3,763,348 A 10/1973 Costello
3,788,560 A 1/1974 Hough et al.
3,790,912 A 2/1974 Murphy
3,801,753 A 4/1974 Szymber
3,899,236 A 8/1975 Santos
3,910,672 A 10/1975 Frantz ..... 439/405
3,931,487 A 1/1976 Russenberger
3,974,469 A 8/1976 Nicholls
3,993,885 A 11/1976 Kominami et al.
4,019,801 A 4/1977 Hoffman
4,041,427 A 8/1977 Chusha ..... 335/205
4,055,736 A 10/1977 Congelliere
4,062,626 A 12/1977 Kawakami et al.
4,089,047 A 5/1978 Luderitz
4,152,755 A 5/1979 Trosper et al. ..... 362/158
4,169,974 A 10/1979 Peers-Trevarton
4,175,222 A 11/1979 Buttner
4,203,017 A 5/1980 Lee
4,241,244 A 12/1980 Swann
4,252,395 A 2/1981 Ward et al.
4,308,440 A 12/1981 Buttner
4,317,015 A 2/1982 Buttner et al.
4,319,106 A 3/1982 Armitage
4,335,287 A 6/1982 Aschenbach et al.
4,345,128 A 8/1982 Buttner et al.
4,413,872 A 11/1983 Rudy et al. ..... 439/467
4,419,169 A 12/1983 Becker et al.
4,419,304 A 12/1983 Ficke et al.
4,460,820 A 7/1984 Matsumoto et al.
4,461,528 A 7/1984 Durand et al.
4,476,359 A 10/1984 Bienwald
4,506,124 A 3/1985 Rose et al.
4,524,253 A 6/1985 Sorenson
4,529,258 A 7/1985 Anthony ..... 439/142
4,541,679 A 9/1985 Fiedler et al. ..... 439/395
4,575,590 A 3/1986 Hattori et al.
4,605,839 A 8/1986 Rasmussen et al.
4,660,919 A 4/1987 Levy ..... 439/418
4,692,573 A 9/1987 Fukuyama et al.
4,713,498 A 12/1987 Ludwig et al.
4,754,104 A 6/1988 Maltais et al.
4,771,141 A 9/1988 Flumignan et al.
4,788,403 A 11/1988 Hayakawa et al.
4,795,860 A 1/1989 Kamada et al.
4,812,620 A 3/1989 Hayakawa et al.
4,858,090 A 8/1989 Downs
4,864,085 A * 9/1989 Hanajima et al. ..... 200/5 A
4,885,443 A 12/1989 Simcoe et al.
4,891,018 A 1/1990 Afflerbaugh et al.
4,891,476 A 1/1990 Nation et al.
4,906,808 A 3/1990 Burgess et al.
4,939,324 A * 7/1990 English et al. ..... 200/345
4,939,328 A 7/1990 Smith
4,978,823 A 12/1990 Sato et al.
5,001,316 A 3/1991 Salaman
5,043,546 A 8/1991 Krause
5,049,709 A 9/1991 Prickett et al.
5,060,289 A 10/1991 Abramson
5,063,276 A 11/1991 Woodard
5,132,499 A 7/1992 Valenzona et al.
5,145,059 A 9/1992 Park
5,158,172 A 10/1992 Roeser et al.
5,178,265 A 1/1993 Sepke
5,186,316 A 2/1993 Mortun et al.
5,194,703 A 3/1993 Deeg
5,201,408 A 4/1993 Torma et al.
5,226,529 A 7/1993 Valenzona
5,268,542 A 12/1993 Voll
5,285,037 A 2/1994 Baranski et al.
5,293,507 A 3/1994 Hayakawa
5,435,747 A 7/1995 Franckx et al.
5,442,150 A 8/1995 Ipcinski
5,456,541 A * 10/1995 Ching-Shui ..... 400/490
5,493,089 A 2/1996 Chasen et al.
5,514,006 A 5/1996 Getselis et al.
5,541,376 A 7/1996 Ladtkow et al.
5,586,645 A 12/1996 Bartok
5,620,086 A 4/1997 Bianca et al.
5,629,659 A 5/1997 Steiner
5,636,729 A 6/1997 Wiciel
5,675,890 A 10/1997 Yamamoto et al.
5,681,182 A 10/1997 Reichle
5,762,707 A 6/1998 Shindo
5,777,282 A 7/1998 Ishiguro et al.
5,785,548 A 7/1998 Capper et al. ..... 439/409
5,847,345 A 12/1998 Harrison
5,871,374 A 2/1999 Maney
5,954,534 A 9/1999 Hale et al. ..... 439/409
5,961,341 A 10/1999 Knowles et al.
5,964,615 A 10/1999 Endres ..... 439/419
5,994,654 A 11/1999 Benson
5,999,072 A 12/1999 Slavik ..... 335/207
6,016,020 A 1/2000 Cline et al.
6,080,006 A 6/2000 Broder
6,093,048 A 7/2000 Arnett et al.
6,106,761 A 8/2000 Sjoberg et al.
6,180,905 B1 1/2001 Pollock et al.
6,191,376 B1 2/2001 Bartok
6,196,861 B1 3/2001 Saligny
6,231,373 B1 5/2001 Daoud
6,236,006 B1 5/2001 Wecke
6,254,421 B1 7/2001 Denovich et al. ..... 439/409
6,264,495 B1 7/2001 Robertson et al. ..... 439/409
6,312,282 B1 11/2001 Blaha et al.
6,406,324 B1 6/2002 Duesterhoeft et al. ..... 439/409
6,426,486 B1 7/2002 Bartok
6,537,101 B1 3/2003 Wang
6,635,838 B1 10/2003 Kornelson ..... 200/341
6,636,135 B1 10/2003 Vetter
6,682,363 B1 1/2004 Chang
6,729,016 B2 5/2004 Wieger et al.
6,737,596 B1 5/2004 Hein
6,864,454 B2 3/2005 Shimizu et al.
6,974,918 B2 12/2005 Blossfeld
7,090,529 B1 8/2006 Wang
7,256,671 B1 8/2007 Preaux ..... 335/207
2002/0106929 A1 8/2002 Nagai
2004/0163940 A1 8/2004 Ravnkilde et al.
2007/0102275 A1 * 5/2007 Genz et al. ..... 200/406

FOREIGN PATENT DOCUMENTS

JP 09-257374 10/1977
WO WO 97/10936 3/1997

OTHER PUBLICATIONS

Eraser Company Inc., Syracuse New York, Glo-ring Infrared Heat tools.
"Tube Shrinking Systems" relating to a Model 4825 easyShrink.TM. Workstation.

* cited by examiner

MOMENTARY PUSH BUTTON SWITCH

FIELD OF THE INVENTION

The present invention relates to an electrical switch, and in particular to a push button switch.

BACKGROUND OF THE INVENTION

Electrical switches are used to make electrical connections or contacts between electrical wires. As compared with conventional toggle switches, push button switches usually occupy less space and make faster electrical contacts. Push button switches are commonly used in automobiles, flashlights, and many other circuitries for ON-OFF switching or for toggling between various modes. However, existing push button switches do not provide accurate audible feedback is for making or breaking electrical contact.

BRIEF SUMMARY OF THE INVENTION

The present invention provides a method and a switch apparatus with an audible indication substantially concurrently or simultaneously with establishment of an electrical contact.

In one aspect, the invention provides an electrical switch apparatus, which in accordance with a preferred embodiment includes a contact member and a push button configured to press directly against the contact member when the electrical switch apparatus is in a closed state. The contact member is configured to make an electrical contact substantially concurrently with a first audible feedback when pressed by the push button at a pressure higher than a predetermined threshold.

In one embodiment, the apparatus further includes a spring member to coupled to the push button. The apparatus may have a housing and a cover forming an enclosure that partially encloses the push button and substantially encloses the contact member.

In one embodiment, the apparatus includes a first electrical terminal and a second electrical terminal, wherein the contact member is configured to make the electrical contact between the first electrical terminal and the second electrical terminal. The first and second electrical terminals each have a retaining portion for retaining an electrical wire. The first and second electrical terminals each have a contact portion, and the contact portion of the second terminal is formed at an angle relative to the retaining portion. The contact member and the first electrical terminal are in constant electrical contact. The contact member has a plurality of legs, and one of the legs is always in electrical contact with the contact portion of the first electrical terminal.

The contact member may be made of stainless steel.

In one embodiment, the contact member is substantially dome shaped, and the contact member is configured to make the first audible feedback substantially concurrently with the establishment of the electrical contact. Preferably the contact member is configured to make the electrical contact within about 0.3 milliseconds from making the audible feedback.

The contact member may be configured to make a second audible feedback when the push button is released, and wherein the second audible feedback is different from the audible feedback when making the electrical contact.

In one embodiment, the push button has a plunger portion having a tip configured to press directly against a center portion of the contact member. The switch may further comprise a plunger cover substantially enclosing the tip of the plunger portion, wherein the plunger cover is removably coupled to the push button, and wherein the plunger cover and the tip are made of different materials.

In another aspect, the present invention provides a method for providing an electrical contact using a substantially dome-shaped contact member substantially concurrently with making an audible feedback. The method includes pressing a push button directly against a center portion of the contact member, and thereby deforming the contact member to make the electrical contact. The contact member is configured to make a first audible feedback substantially concurrently with making the electrical contact when pressed at a pressure higher than a predetermined threshold.

In one embodiment, the contact member is configured to make the first audible feedback within a first time interval of less than 0.3 milliseconds of establishing the electrical contact. The contact member may be further configured to make a second audible feedback within a second time interval from breaking the electrical contact, wherein the second time interval is substantially longer than the first time interval.

The method may further comprise adjusting the first audible feedback by removably coupling a plunger cover to a plunger portion of the push button, wherein the plunger cover and the plunger portion are made of different materials.

In another aspect, the present invention provides an electrical system, including a plurality of electrical wires, and a switch for making an electrical contact between at least two of the plurality of electrical wires, wherein the switch includes a contact member, and a push button configured to press directly against the contact member when the electrical switch apparatus is in a closed state. The contact member is configured to make the electrical contact substantially concurrently with an audible feedback when pressed by the push button at a pressure higher than a predetermined threshold.

In one embodiment, the contact member is made of stainless steel. The contact member may be substantially dome shaped, and the audible feedback includes a clicking sound. The contact member is preferably configured to make the electrical contact within about 0.3 milliseconds from making the clicking sound. The predetermined threshold is preferably about 3.9 N.

In another aspect, the present invention provides an electrical switch assembly including a switch body, a contact member substantially enclosed in the switch body, a push button partially enclosed in the switch body and configured to press directly against the contact member when the electrical switch apparatus is in a closed state, and a plurality of terminals configured for making electrical contacts with the contact member, wherein the contact member is configured to make an electrical contact substantially concurrently with a first audible feedback when pressed by the push button at a pressure higher than a predetermined threshold.

In one embodiment, the switch body further includes a locking ring for locking the switch assembly onto a panel or a wall. The switch body may further include a guard ring around the push button, and wherein a diameter of the push button is smaller than a diameter of the locking ring.

These and other features, aspects and advantages of the present invention will become understood with reference to the following description, appended claims and accompanying figures.

DETAILED DESCRIPTION OF THE INVENTION

The present invention provides an electrical push button switch that provides audible feedback for making and/or breaking electrical contact. Exemplary implementations of the present invention described below provide an audible indication when electrical connection is made and/or broken via the switch, to keep a user informed of the timing and operation modes of the switch.

Figure 1A:
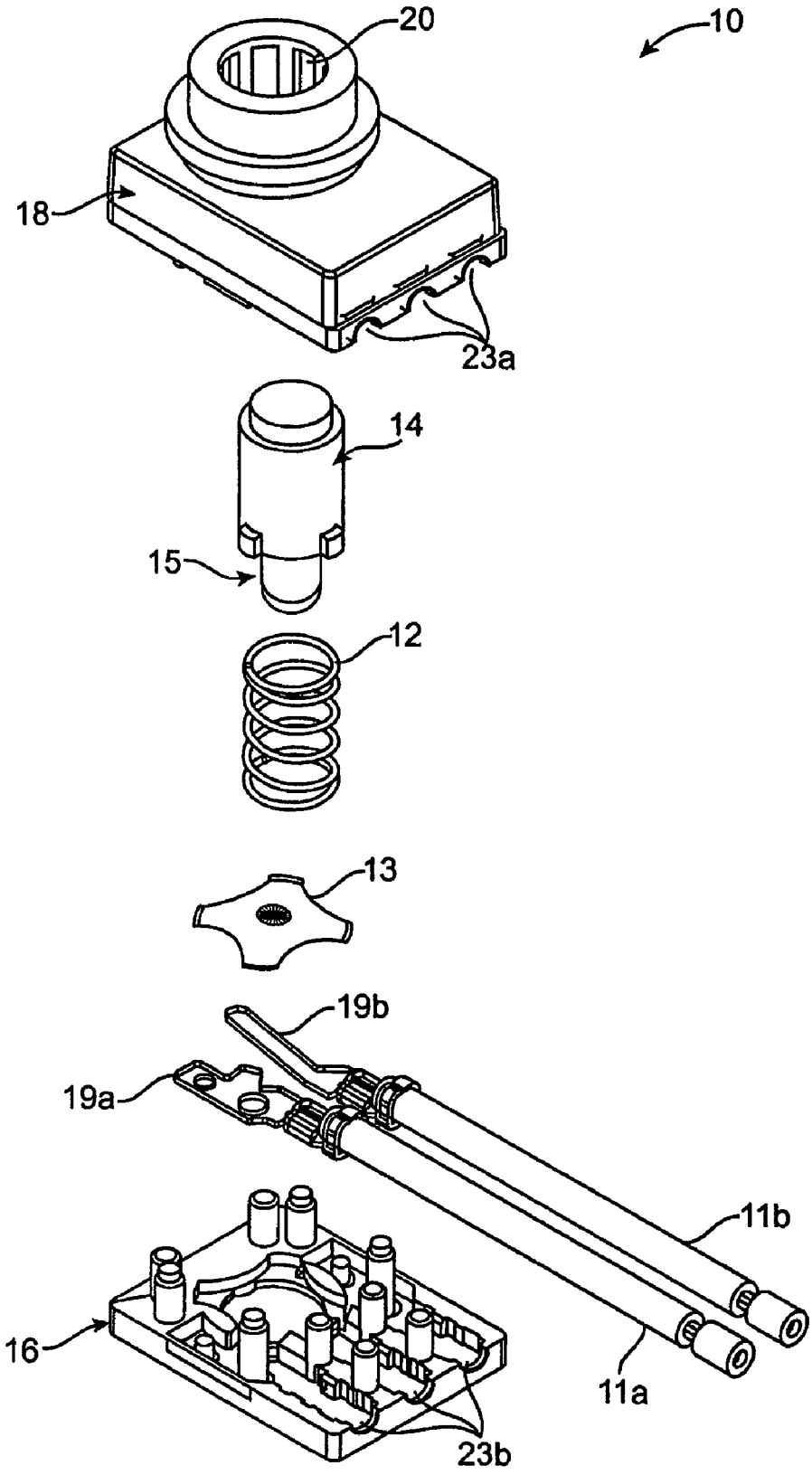
FIG. 1A shows an exploded view of an electrical switch assembly in accordance with an embodiment of the invention.
Figure 1B:
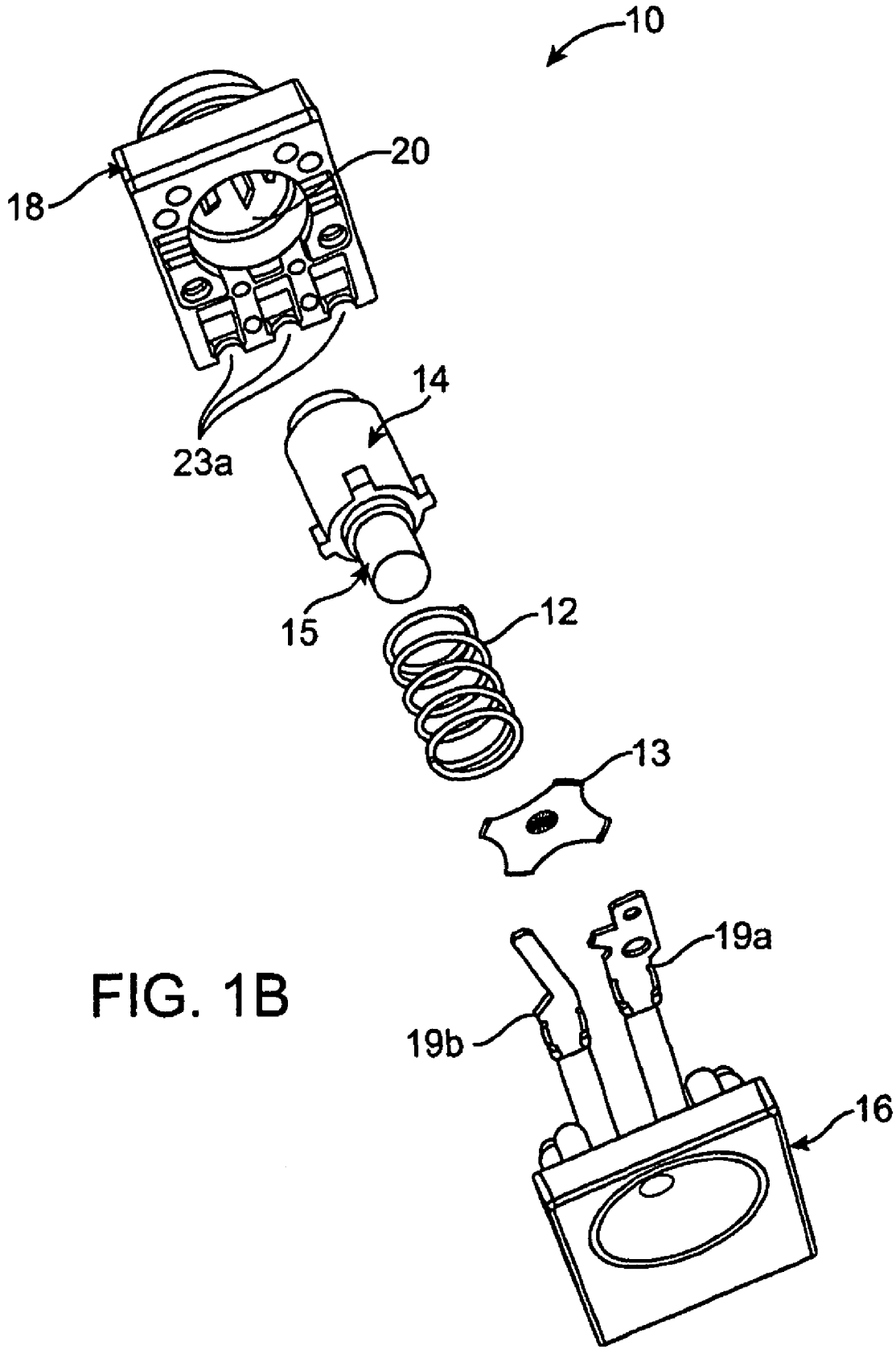
FIG. 1B shows the unassembled electrical switch assembly of FIG. 1A from a different angle.
Figure 2A:
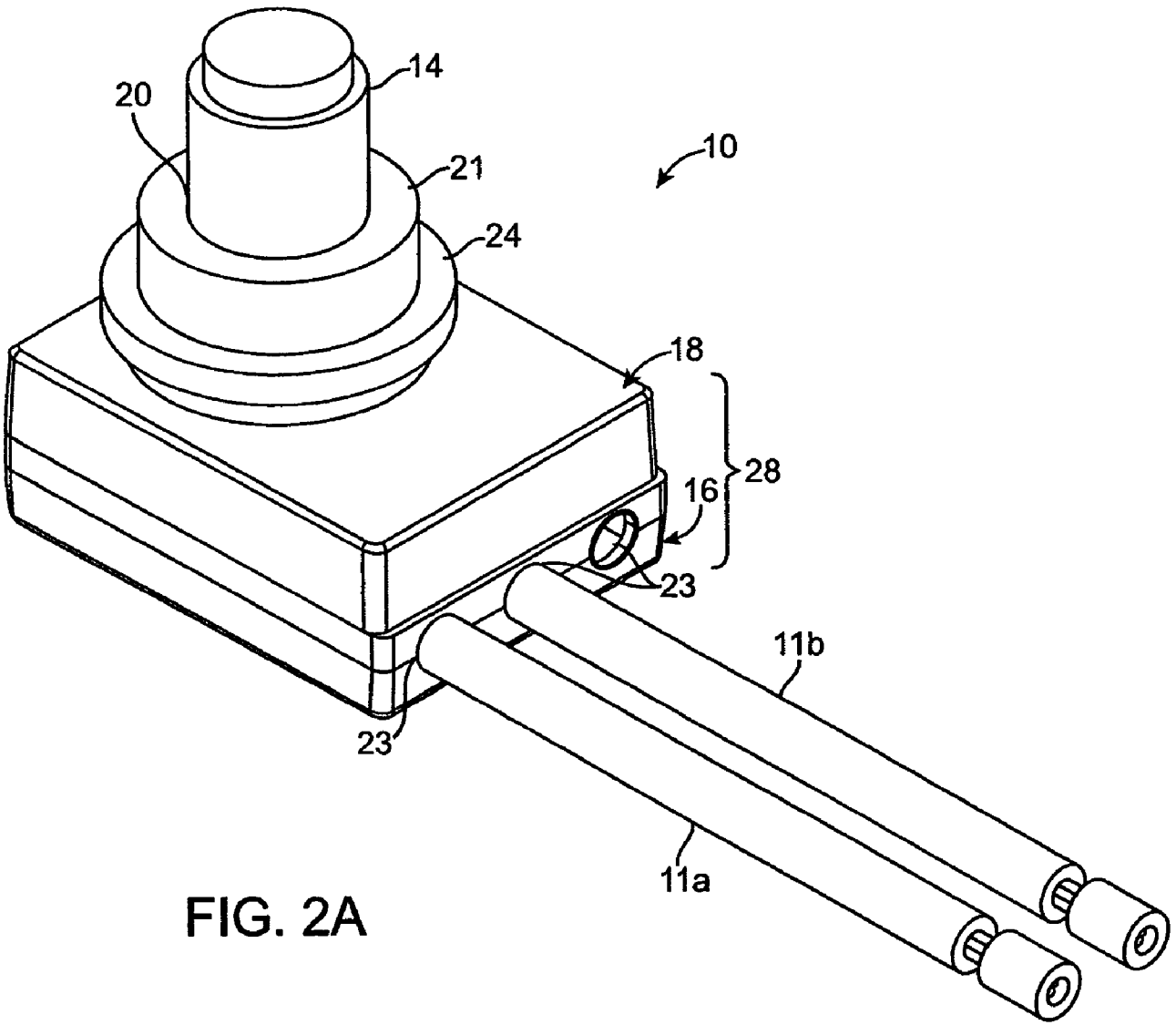
FIG. 2A shows a perspective view of an assembled electrical switch.

FIG. 1A shows an exploded view of an electrical momentary push button switch 10 in accordance with an embodiment of the invention. As shown, the push button switch 10 may be connected to an electrical system using a plurality of wires or leads 11*a*, 11*b*. The switch 10 includes a spring member 12, a contact member 13, a push button 14, a cover 16, a housing 18 and terminals 19*a*, 19*b* that can be coupled to the wires 11*a*, 11*b*, respectively (the switch 10 may or may not include the wires 11*a*, 11*b*). The housing 18 has a plurality of cut-aways 23*a*, which as shown are half-circular shaped. The push button 14 includes a plunger portion 15. The cover 16 has a plurality of corresponding cut-aways 23*b*. The cover 16 and the housing 18 together may be referred to as the switch body 28 (FIG. 2A). FIG. 1B shows the unassembled momentary push button switch 10 of FIG. 1A from a different angle, illustrating more details of the housing 18.

FIG. 2A shows a perspective view of an assembled switch 10. As shown, when the push button switch 10 is assembled, the switch body 28 including the cover 16 and the housing 18 substantially encloses the spring 12, the contact member 13 and terminals 19*a* and 19*b*, and partially encloses the push button 14.

The cover 16 and the housing 18 may be made of, for example, injection molded plastic. Designating parts of the switch 10 as the cover 16 and the housing 18, for example, is simply a matter of convenience for description. The enclosure, e.g., the cover 16 and the housing 18, of the switch 10 can be manufactured from more or fewer parts to enclose components such as the spring 12, the contact member 13 and terminals 19*a* and 19*b*. In addition, the switch 10 to can be installed and operated in any position, such as the push button 14 pointing upward, downward, or angled relative to the operator. Thus, designating the cover 16 and the housing 18 does not indicate a preferred orientation of the switch 10.

The housing 18 includes an aperture 20 for the push button 14 to extend therethrough, and a guard ring 21 surrounding the push button 14. The cut-aways 23*a* of the housing 18 and the cut-aways 23*b* of the cover 16 (FIG. 1A) form a plurality of apertures 23 (FIG. 2A) when the switch 10 is assembled, allowing the electrical wires 11*a* and 11*b* to extend therethrough. Some of the apertures 23 may be reserved, for example, for closing lines. The apertures 23 as shown are substantially circular in shape. However, those of ordinary skill in the art will recognize that other shapes are possible, and that the apertures 23 are not necessarily formed with cut-aways in both the housing 18 and the cover 16.

Figure 2B:
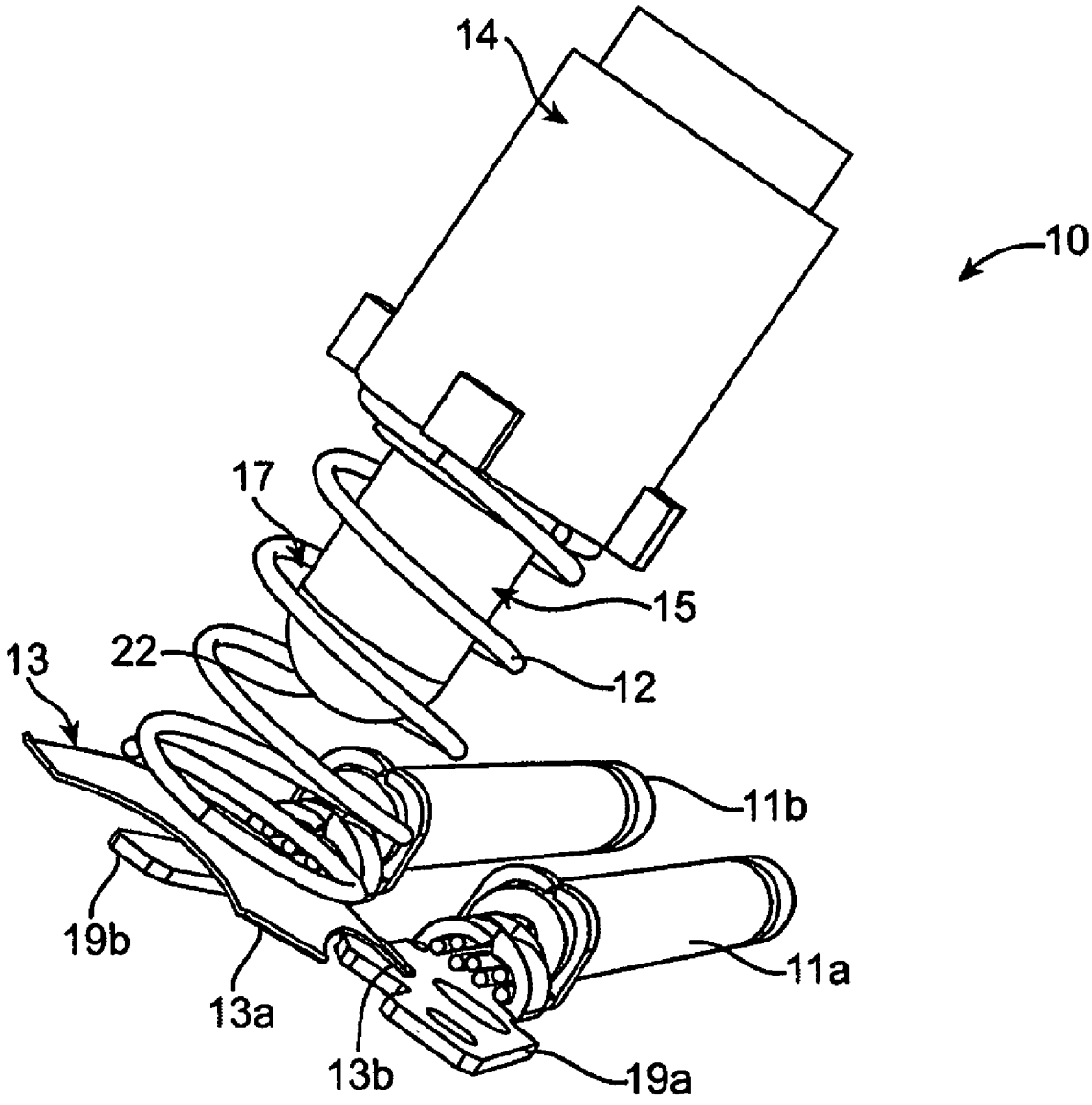
FIG. 2B shows a perspective view of an internal structure of the electrical switch of FIG. 2A.

FIG. 2B shows a perspective view of the internal structure of the assembled electrical switch 10 of FIG. 2A with the housing 18 and the cover 16 not shown, for clarity. The push button 14 is concentric with the spring 12, wherein the plunger portion 15 of the push button 14 is disposed within the core (center) 17 of the spring 12. FIG. 2B shows the push button 14 and the spring 12 in its fully uncompressed state.

The switch 10 is in a normally open state as shown in FIG. 2B, where the button 14 is not pushed and is supported by the spring 12 to be away from the to contact member 13. The switch 10 can be closed by pressing the button 14, which compresses the spring 12 causing a tip 22 of the plunger portion 15 to compress the contact member 13, which makes an electrical contact between terminals 19*a* and 19*b*. When the button 14 is released, the switch 10 returns to its open state as the contact member 13 returns to the dome shape and breaks the electrical contact.

Figure 3A:
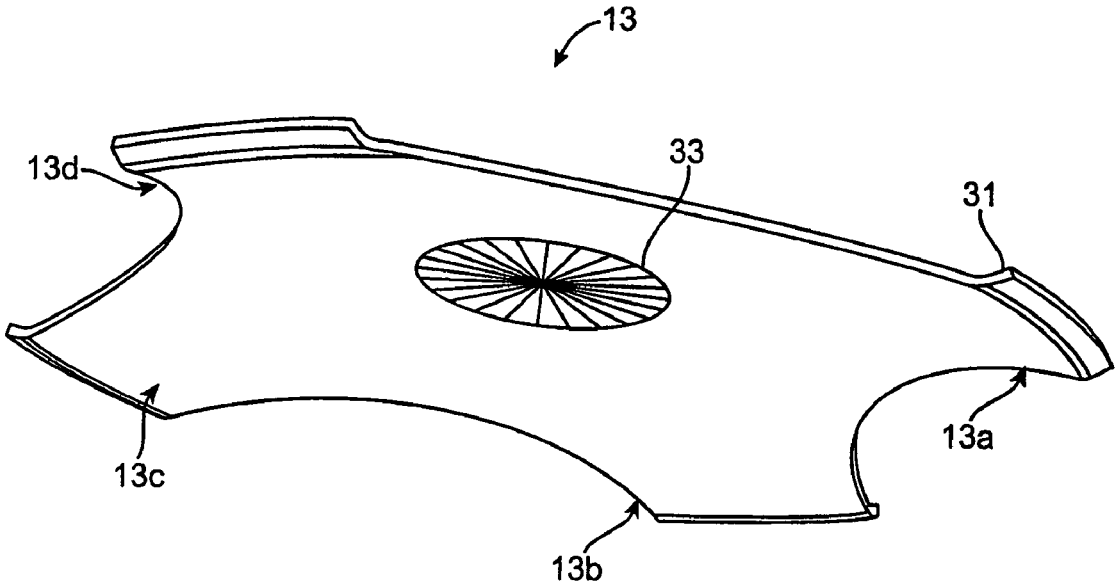
FIG. 3A shows a perspective view of a substantially dome-shaped contact member of the switch.
Figure 3B:
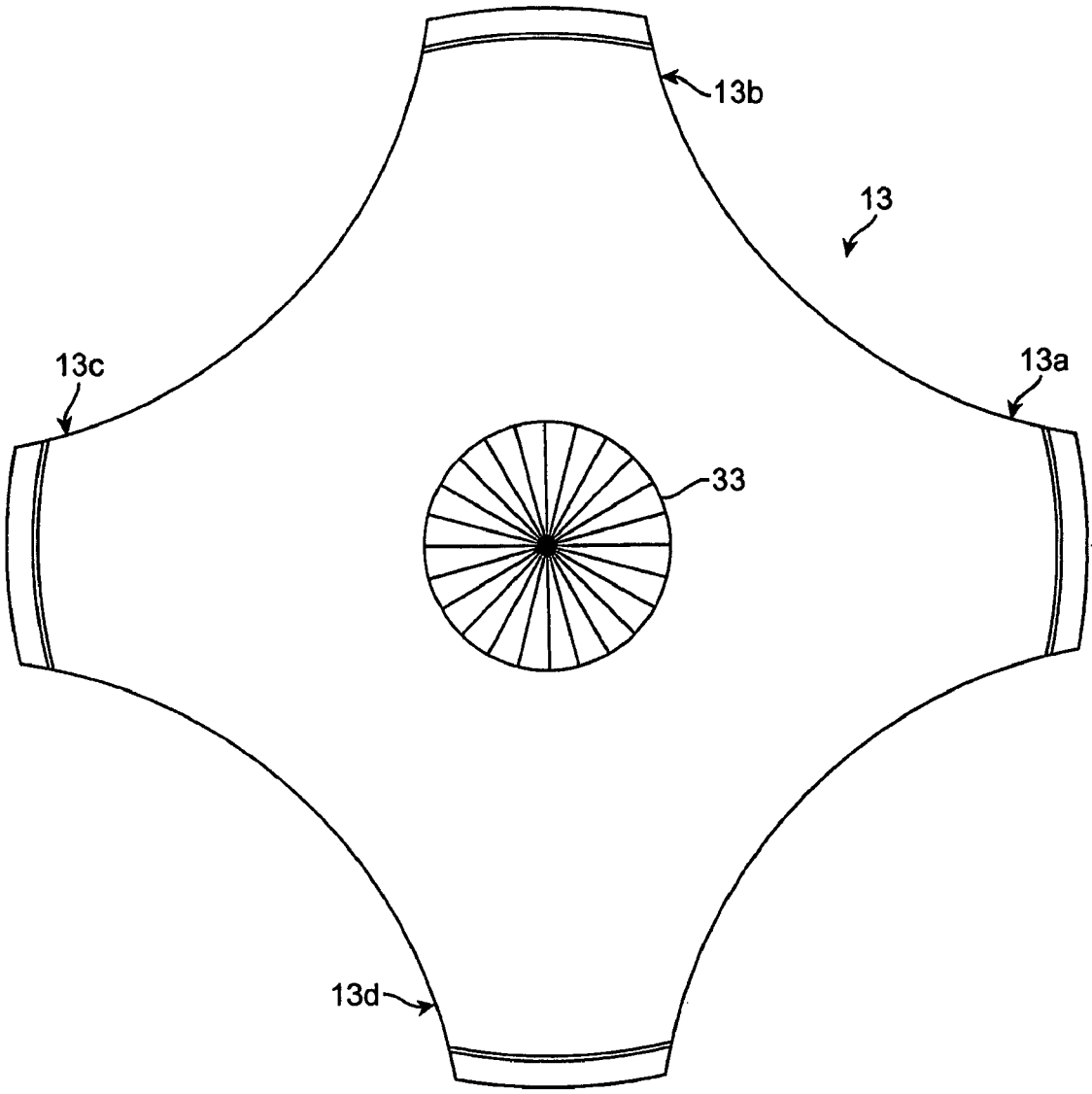
FIG. 3B shows a top view of the contact member of FIG. 3A.
Figure 3C:
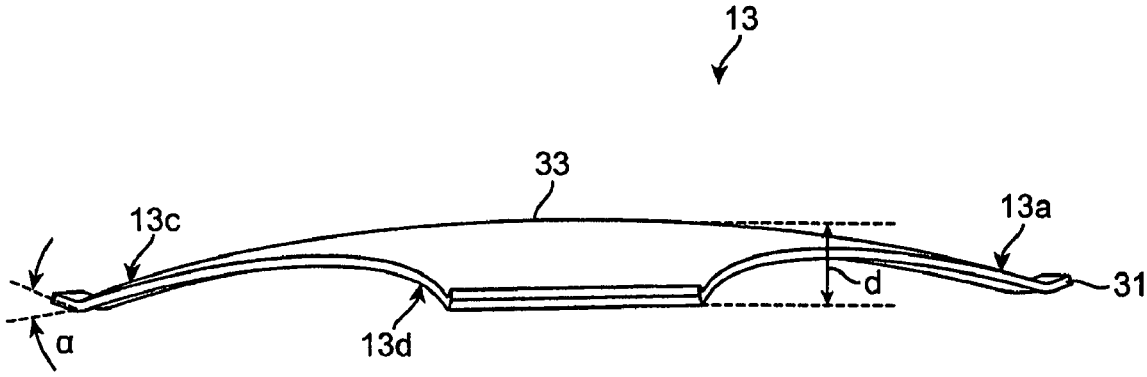
FIG. 3C shows a side view of the contact member of FIG. 3A.

Referring to FIGS. 3A-3C, in one implementation, the contact member 13, when uncompressed is substantially "dome" shaped, wherein the contact member 13 comprises a plurality of contact legs (e.g., 13*a*, 13*b*, 13*c*, 13*d*). The contact member 13 may be unitarily formed using a resilient, conductive, material, for example, stainless steel. The material and the "dome" shape of the contact member 13 are selected to provide the contact member 13 with spring loaded characteristics, wherein without external pressure, the contact member 13 always returns to its original dome shape shown in FIGS. 3A-3C.

Specifically, FIG. 3A shows a perspective view of the substantially dome-shaped contact member 13. Each of the contact legs 13*a*-13*d* has a tilted portion 31, which as discussed further below helps secure the contact member 13 in the cover 16. Each of the legs 13*a*-13*d* may have a corresponding electrical terminal. In the embodiment shown in FIG. 2B, only two electrical terminals 19*a* and 19*b* are present. Thus, only corresponding legs 13*b* and 13*d* of the contact member 13 are used for making/breaking electrical contact. The other legs 13*a* and 13*c* may provide some mechanical support for the dome, but are not used for making/breaking electrical contact in this embodiment. Those of ordinary skill in the art will appreciate that, more or fewer contact legs for the contact member 13 may be implemented as the number of the electrical terminals varies.

FIG. 3B shows a top view of the contact member 13 of FIG. 3A, and FIG. 3C shows a side view of the contact member 13, illustrating an angle α between the tilted portions 31 relative to the legs 13*a-d*. In one embodiment, the angle α is in the range between 10° and 60°, and is preferably about 30°.

Figure 3D:
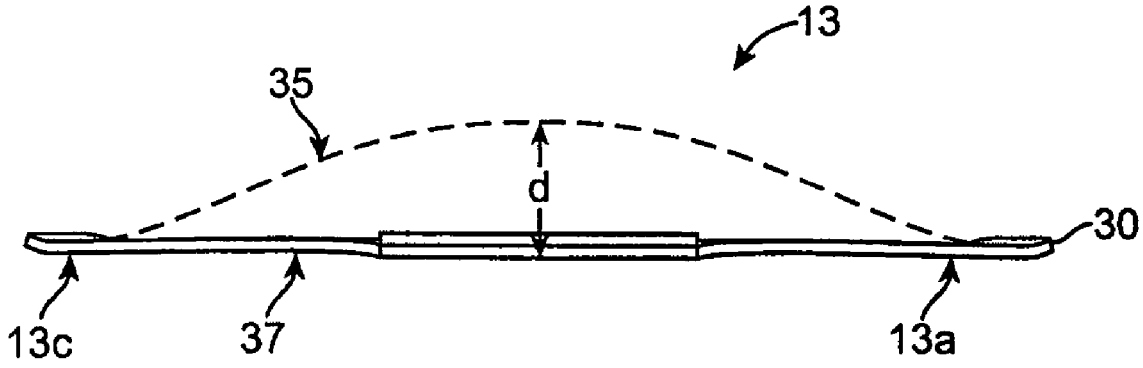
FIG. 3D shows a side view of the contact member in its compressed, or flattened, state as compared with its normal state.
Figure 3E:
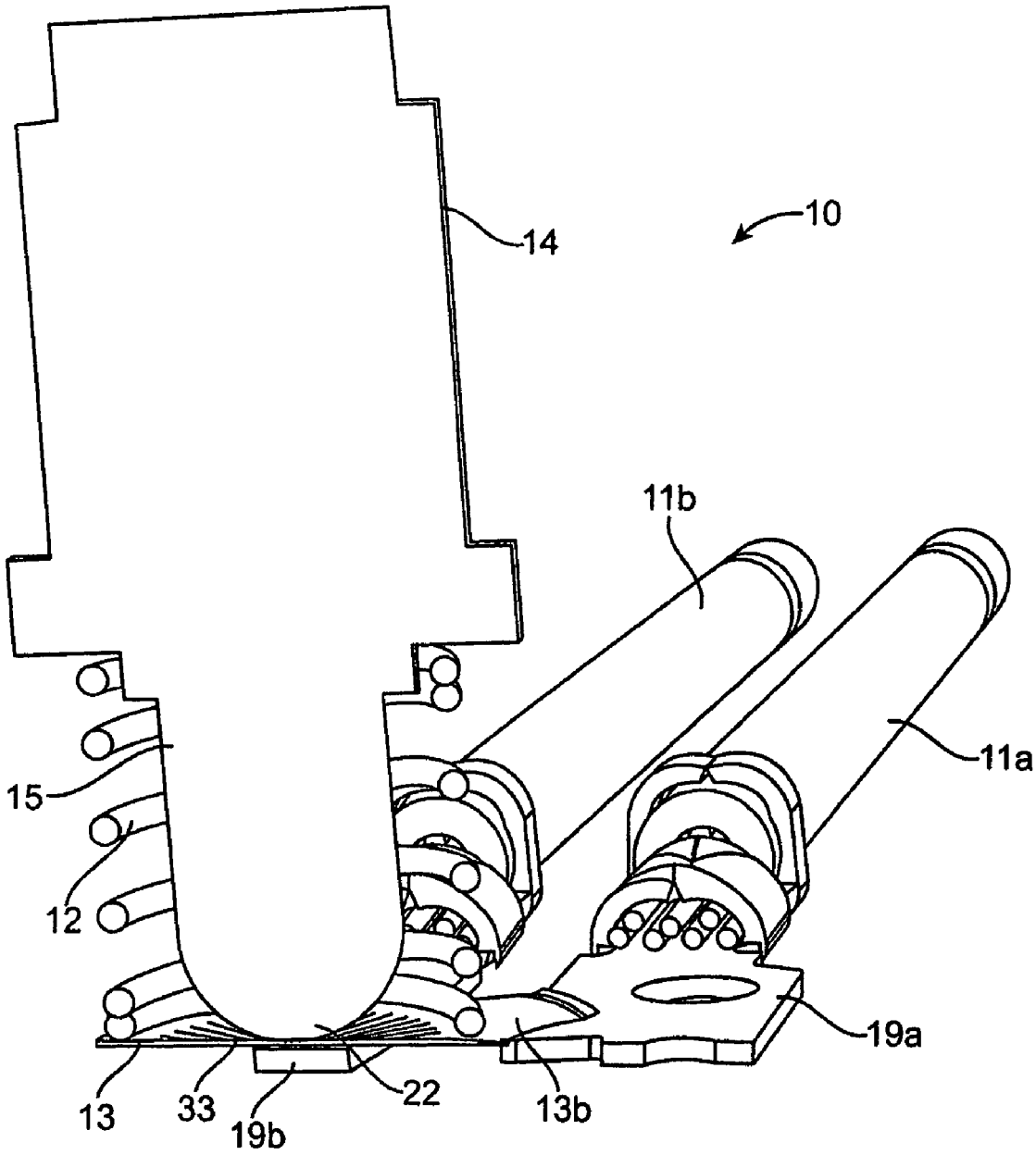
FIG. 3E shows a partially-cut perspective view of the internal structure of the electrical switch of FIG. 2B in its connected, or closed, state.

Referring to FIGS. 3C-3E, in one implementation, the dome shaped contact member 13 is configured such that the center portion (i.e., dome) 33 is more susceptible to deformation (e.g., relative to the legs 13*a*-13*d*) and generating an audible feedback (e.g., clicking sound) when the center portion 33 of the contact member 13 is compressed by the tip 22 of the plunger portion 15 (FIG. 3E) from an uncompressed state 35 (FIG. 3D) to a fully compressed state 37 (FIGS. 3D-3E). This may be achieved, for example, by making the center portion 33 with physical properties (e.g., thickness, texture, material), different from those of other portions (e.g., legs 13*a-d*) of the contact member 13.

For example, when the center portion 33 of the contact member 13 is exposed to a compression pressure higher than a predetermined threshold, (e.g., about 3.9 N), the contact member 13 deforms to a compressed, or flattened, state 37, as shown in FIGS. 3D-E.

FIG. 3D compares the uncompressed position 35 and the compressed position 37 of the contact member 13. During the compression process from the uncompressed state 35 to the compressed (deformed) state 37, the center portion 33 travels a distance d to make electrical contact with the terminal 19*b* and substantially concurrently generates an audible sound due to deformation.

Preferably, a time difference t between generating said audible sound, and making electrical contact between the center portion 33 and the terminal 19*b*, is less than a selected threshold value. Based on the overall dimensions of the switch 10, travel distance d has a predetermined value selected based on a time t between: (1) making electrical contact (i.e., the center portion 33 electrically contacting the terminal 19*b*) and (2) generating said audible sound due to deformation of the center portion 33, wherein $0 \leqq t < \text{threshold}$. In one example, the distance d is about 0.024 inch, to realize a specified t less than 0.3 milliseconds, such that the time difference t between generating an audible sound (e.g., a mechanical clicking) due to deformation of the center portion 33, and making electrical contact between the center portion 33 and the terminal 19*b*, is less than 0.3 milliseconds.

FIG. 3E shows a partially-cut perspective view of the internal structure of the electrical switch 10 of FIG. 2B in its making contact (connected), or closed, state. As shown, the spring member 12, which surrounds the plunger portion 15 of the push button 14, is compressed when the button 14 is pressed into the housing 18 such that the tip 22 of the plunger portion 15 presses against the contact member 13, compressing the contact member 13. As a result, the contact member 13 deforms and substantially flattens from dome state 35 into flat state 37, generating an audible sound within a time period t of the center 33 of the contact member 13 coming in electrical contact with the terminal 19*b*.

In this closed state, the contact leg 13*b* of the contact member 13 is in electrical contact with the terminal 19*a*, and the center 33 of the contact member 13 is in electrical contact with the terminal 19*b*. As a result, electrical contact is established between the terminals 19*a* and 19*b* through the contact member 13.

By pressing the push button 14, which is made of a relatively stiff material such as plastic, directly on the contact member 13, embodiments of the invention advantageously allow an electrical connect be established faster than if the spring 12 is used to compress the contact member 13 to cause the contact member 13 to flatten.

In the embodiment shown in FIG. 2B, the spring 12 is mainly to keep button 14 away from the contact member 13 in the normally open state, and contributes little to the pressure received by the center 33 of the contact member 13 when the button 14 is pressed down towards the content member 13 while compressing the spring 12.

In the above exemplary implementation of the contact member 13, making electrical contact with the terminal 19*b* and substantially concurrently generating an audible sound due to deformation involves: generating an audible sound within a specified time interval t, preferably less than 0.3 milliseconds, of the portion 33 making electrical contact with the terminal 19*b*. Another implementation involves making electrical contact with the terminal 19*b* within a specified time interval, preferably less than 0.3 milliseconds, of generating an audible sound.

By generating an audible sound substantially concurrently with making electrical contact, the momentary push button switch 10 provides an audible feedback to the user of making or breaking electrical contact.

When applied to, for example, a flashlight, the audible sound provides the user with a feedback indicating an operation mode or status of the flashlight which the user may otherwise be unaware of. If the time interval t between the clicking sound and the establishment of the electrical contact is too long, e.g., substantially longer than 0.3 milliseconds, the feedback becomes less useful to the user.

When pressure is removed from the push button 14, the spring 12 pushes the tip 22 of the push button 14 away from the center portion 33 of the contact member 13. In one implementation, this causes the center portion 33 to revert from the flat state 37 (FIG. 3D) to the dome state 35, breaking electrical contact with the terminal 19*b* and also generating a second audible sound substantially concurrently with (e.g., within a time period T milliseconds of) breaking electrical contact.

Specifically, when the push button 14 is released, the contact member 13 bounces back from its compressed state 37 (FIG. 3D) to its normal state 35, while the switch 10 breaks contact (is turned off). This process may be configured to occur during a specified time interval T (e.g., T<6 milliseconds), between the second audible sound and the turning off of the switch 10. Further, the second audible sound may be different from the first audible sound in that the second clicking sound may last longer and/or have a lower/higher pitch to indicate breaking contact. Preferably the second clicking sound has a lower pitch and lasts longer as compared with the first clicking sound. By generating an audible sound substantially concurrently with breaking electrical contact, the momentary push button switch 10 provides an audible feedback for breaking electrical contact. The values t and T may be the same, or may be different. The audible sound is of a specified loudness such that the sound can be heard from a distance of a few feet or more, such that in various applications such as on a flashlight or in an automobile the audible sound can be positively identified by the user.

Figure 4A:
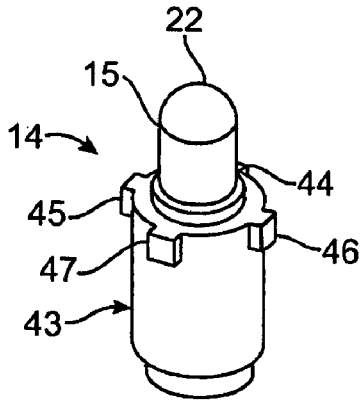
FIGS. 4A-4F show various views of a push button of the switch.
Figure 4B:
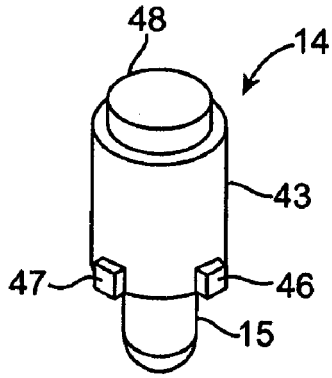

FIGS. 4A-4F show more details of the push button 14 of the switch 10. As shown in FIG. 4A, the push button 14 has a plunger portion 15 and a push button body 43. The plunger portion 15 has a semispherical tip 22 configured to press against the center portion 33 of the contact member 13. The body 43 has a plurality of protrusions 44-47. In the view of FIG. 4B, a pressing portion 48 is shown as part of the push button body 43. When operating the switch 10, an operator presses the pressing portion 48 using, for example, a finger tip. Accordingly, the pressing portion 48 may be made of a material different from the rest of the push button 14. For example, the pressing portion 48 may be made of rubber, which is softer than the plastic body 43, for increased friction between the operator's finger tip and the surface of the pressing portion 48.

Figure 4C:
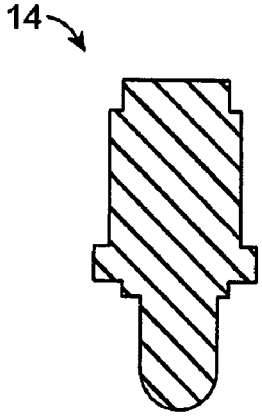
Figure 4D:
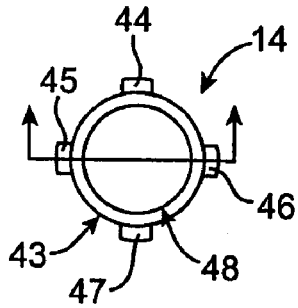
Figure 4E:
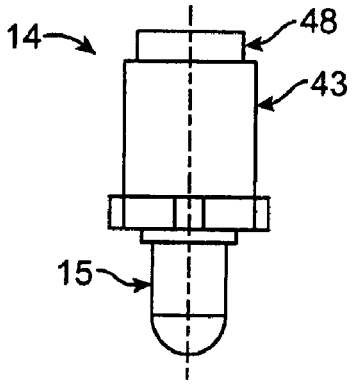
Figure 4F:
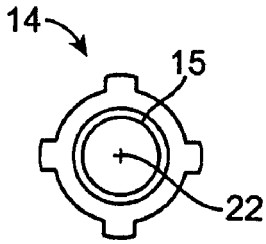

FIG. 4C shows a cross-sectional view of the push button 14, from the A-A section as shown in FIG. 4D, which is a view from the pressing portion 48. FIG. 4E shows a side view. FIG. 4F shows a view of the push button 14 from the tip 22 of the plunger portion 15.

Figure 5A:
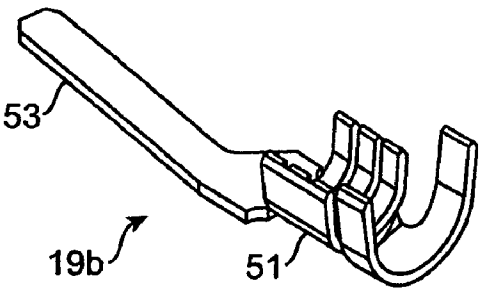
FIGS. 5A-5C show various views of a bottom contact member of the switch.
Figure 5B:
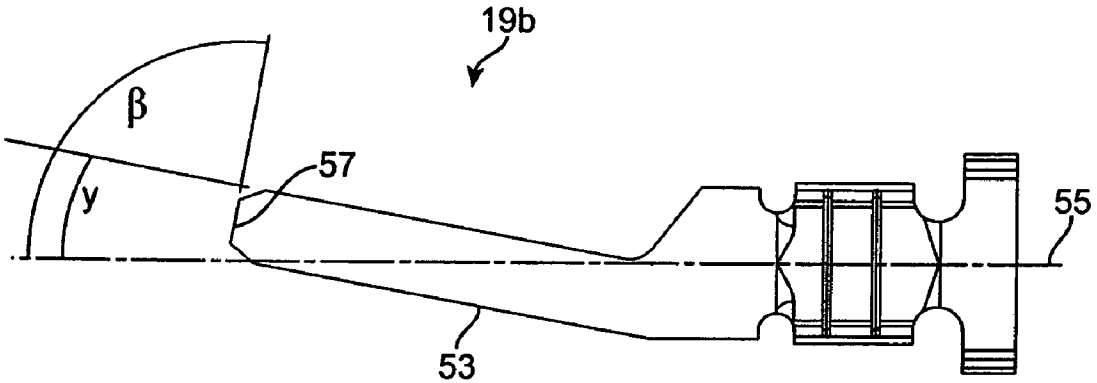
Figure 5C:
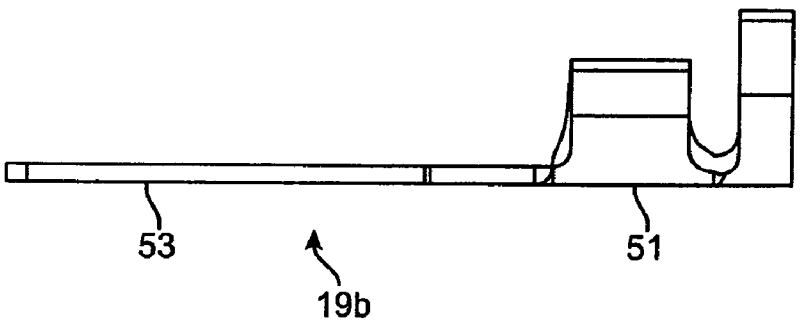

FIGS. 5A-5C show various views of the terminal 19*b* of the switch 10. As shown in the perspective view in FIG. 5A, the terminal 19*b* has a retaining portion 51 for retaining one of the wires 11*b* (FIG. 1), and a contact portion 53 for making electrical contact with the contact member 13 in the closed state. As shown in the top view in FIG. 5B, the contact portion 53 is angled from the longitudinal axis 55 of the retaining portion 51. The relative angle y as shown is in the range of 0° to 40°, and is preferably about 10°. A tip portion 57 is at a relative angle β, which is in the range of 90° to 120°, and preferably about 100°, from the axis 55. Those of ordinary skill in the art will appreciate that, a different angle may be necessary when the terminal is used in conjunction with a different portion of the contact member 13, such as different contact legs. FIG. 5C is a side view of the terminal 19*b*.

Figure 6:
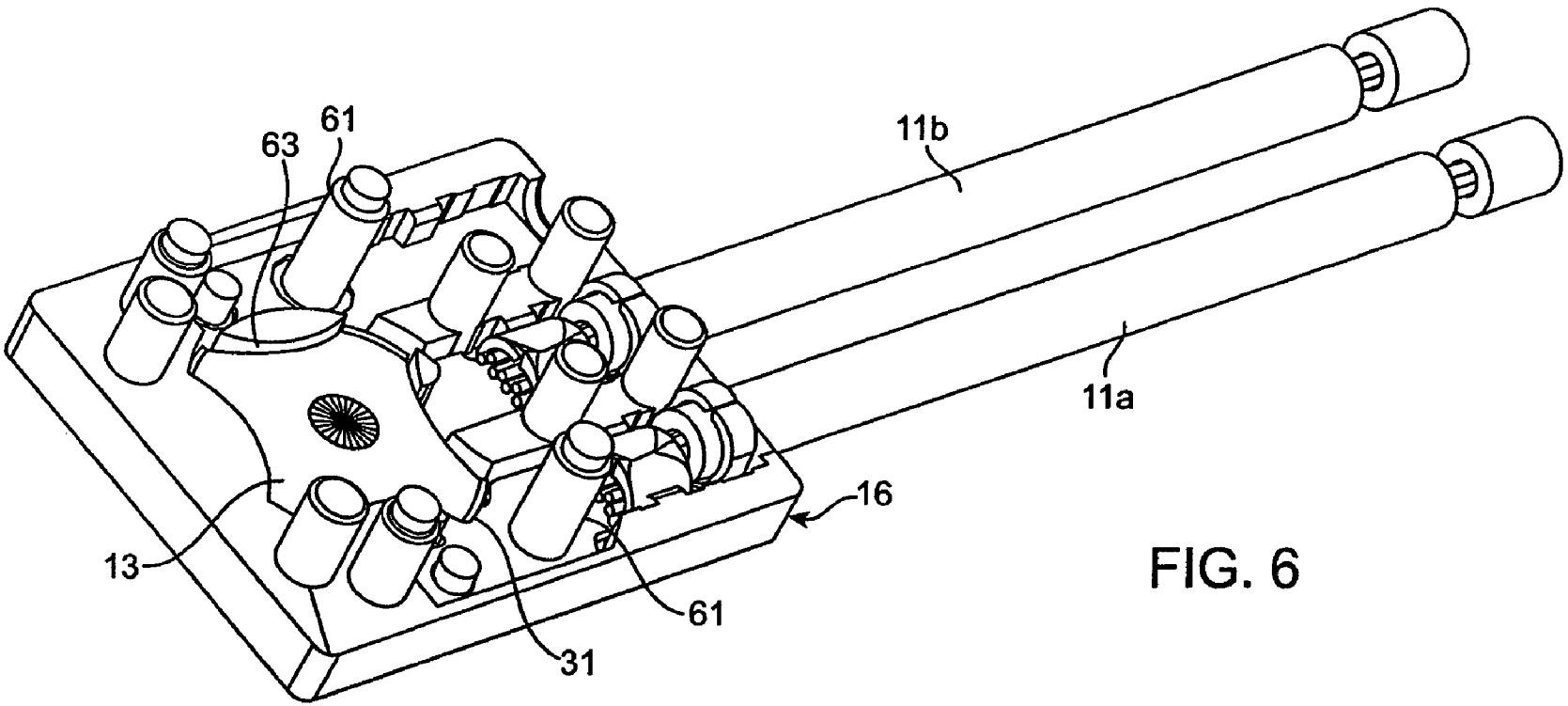
FIG. 6 shows a perspective view of a cover of the switch together with the contact member and the electrical terminals.

FIG. 6 shows a perspective view of the cover 16 of the switch 10. The cover 16 has a plurality of extrusions 61 for mating with corresponding recesses in the housing 18. The cover 16 also has a recess 63 configured to retain the contact member 13. The tilted portion 31 of the contact member 13 helps the contact member 13 being snuggly coupled to the cover 16 at the recess 63.

Figure 7:
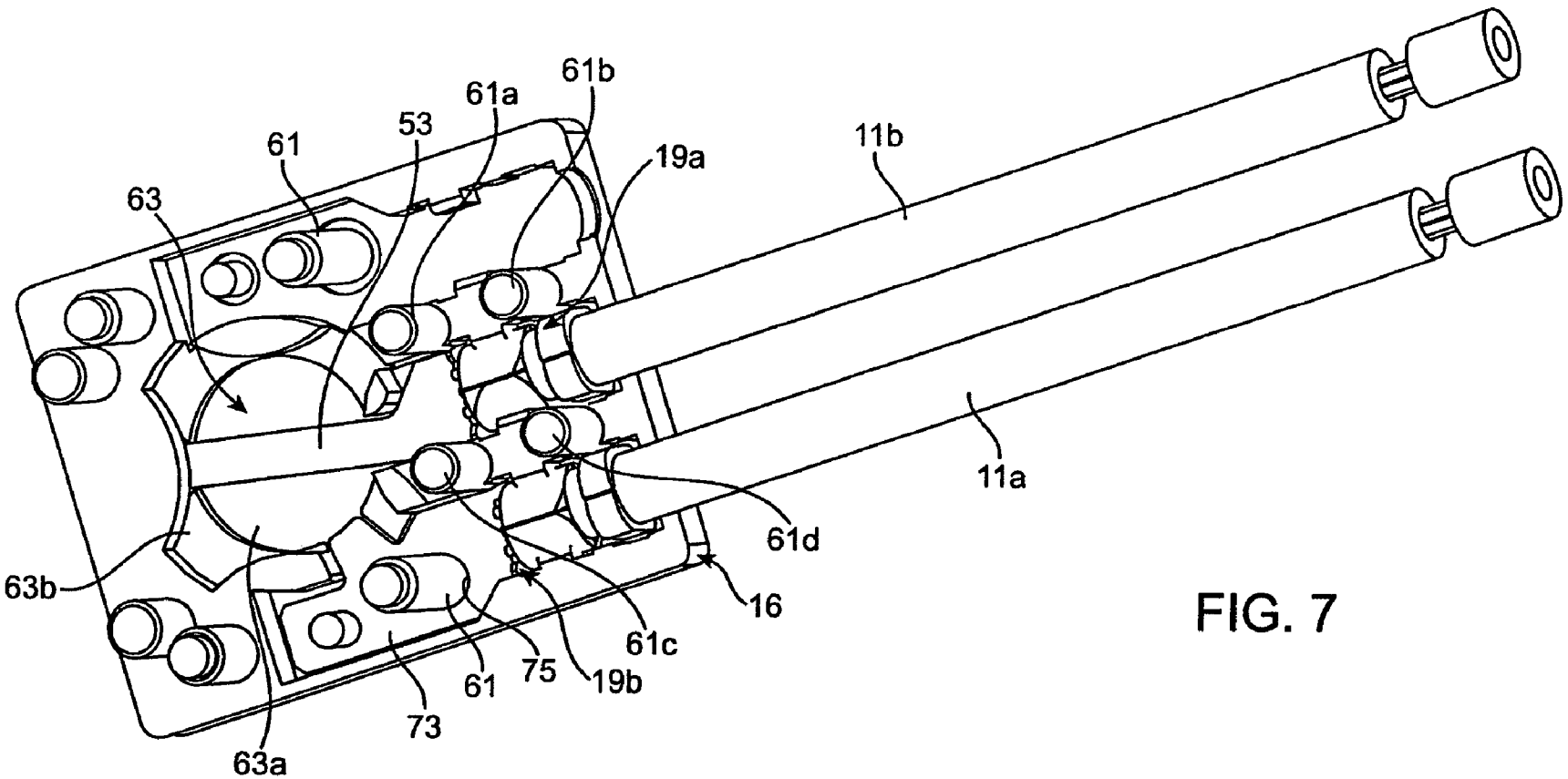
FIG. 7 shows a perspective view of the cover of the switch together with the electrical terminals and without the dome-shaped contact member.

FIG. 7 shows a perspective view of the cover 16 with the contact member 13 removed. The recess 63 has a circular portion 63*a* and a plurality of leg portions such as 63*b*. The recess 63 is shaped to have the contact member 13 fit in. The angled contact portion 53 of the terminal 19*a* extends through the center of the circular portion 63*a* in order to have electrical contact with the center portion 33 of the contact member 13. The contact portion 73 of the terminal 19*b* has one or more apertures 75 to have one or more of the protrusions 61 extend therethrough.

Figure 8B:
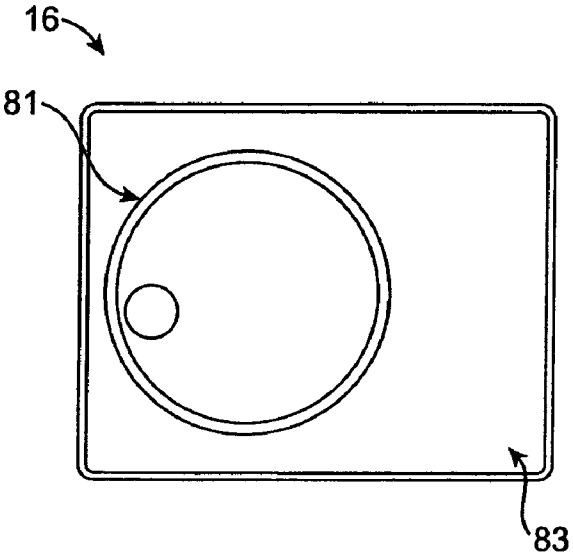
FIGS. 8A-8E show various views of the cover alone of the switch.
Figure 8A:
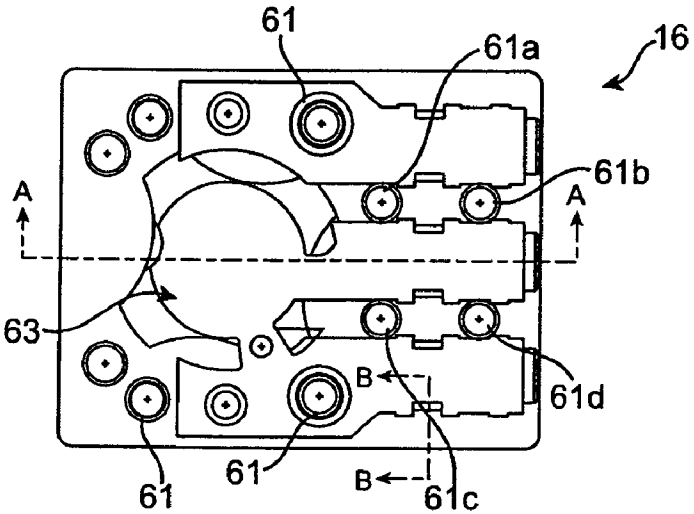
Figure 8E:
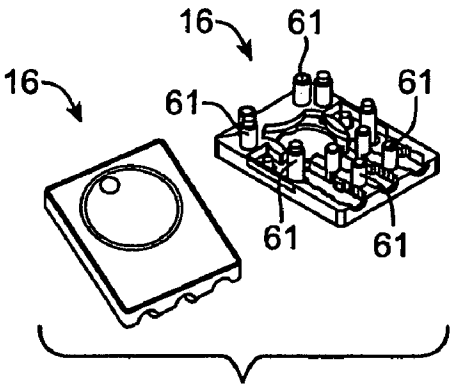
Figure 8D:
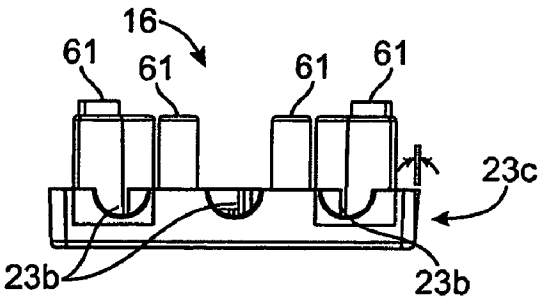
Figure 8C:
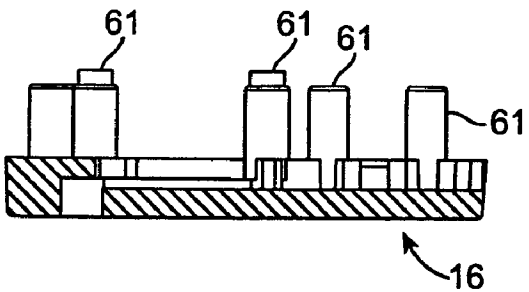

FIGS. 8A-8E show various views of the cover 16. As seen in the internal view in FIG. 8A, a plurality of extrusions 61 are arranged around the recess 63, and are used to mate with the housing 18 shown in FIGS. 9A-9E. Additionally, some of the extrusions, e.g., 61*a*-61*d*, are configured to secure the terminal 19*a* therebetween (FIG. 7). FIG. 8B is an external view of the cover 16, wherein certain patterns such as a company logo 81 may be disposed on an external, bottom, surface 83 of the cover 16. FIG. 8C is a side view of the cover 16. FIG. 8D is a cross-sectional view showing the cut-aways 23*b* at an end 23*c* of the cover 16. FIG. 8E includes perspective views from both sides of the cover 16.

Figure 9B:
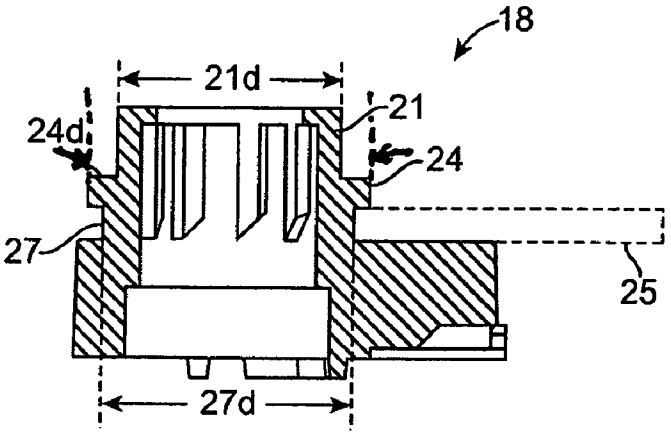
FIGS. 9A-9D show various views of the housing alone of the switch.
Figure 9D:
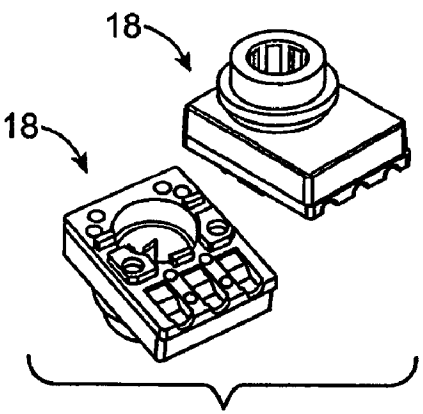
Figure 9A:
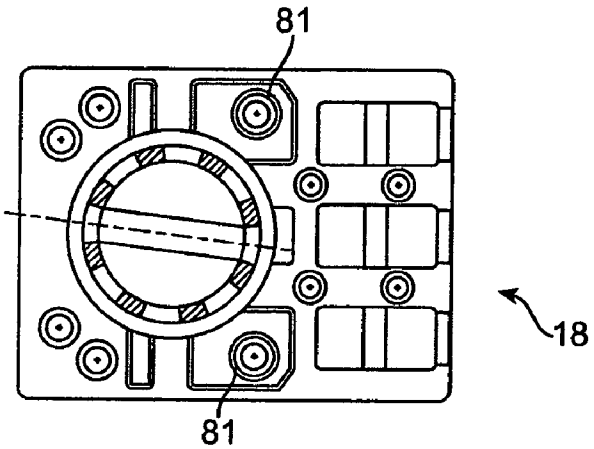
Figure 9C:
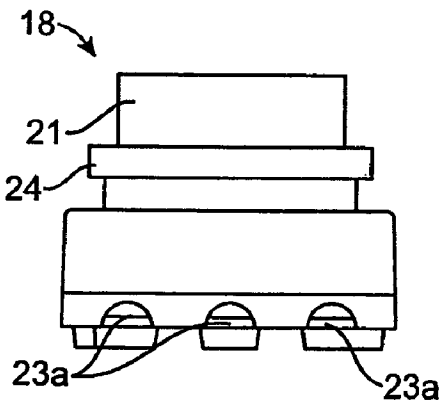

FIGS. 9A-9D show various views of the housing 18. As seen in the internal view in FIG. 9A, a plurality of recesses 81 are configured to receive extrusions 61 (FIG. 8A) from the cover 16. FIG. 9B is a cross-sectional view, and further illustrates the locking ring 24 around the guard ring 21 for locking the switch onto a wall 25. As shown, the outer diameter 21*d* of the guard ring is smaller than the outer diameter 24*d* of the locking ring 24. A portion 27 of the guard ring 21 below the locking ring 24 has a diameter 27*d* also smaller than the outer diameter 24*d* of the locking ring. Thus, the locking ring 24 can lock the housing 18 onto the panel 25 as shown. FIG. 9C is a side view showing the cut-aways 23*a*. FIG. 9D includes perspective views from both sides of the housing 18.

Figure 10A:
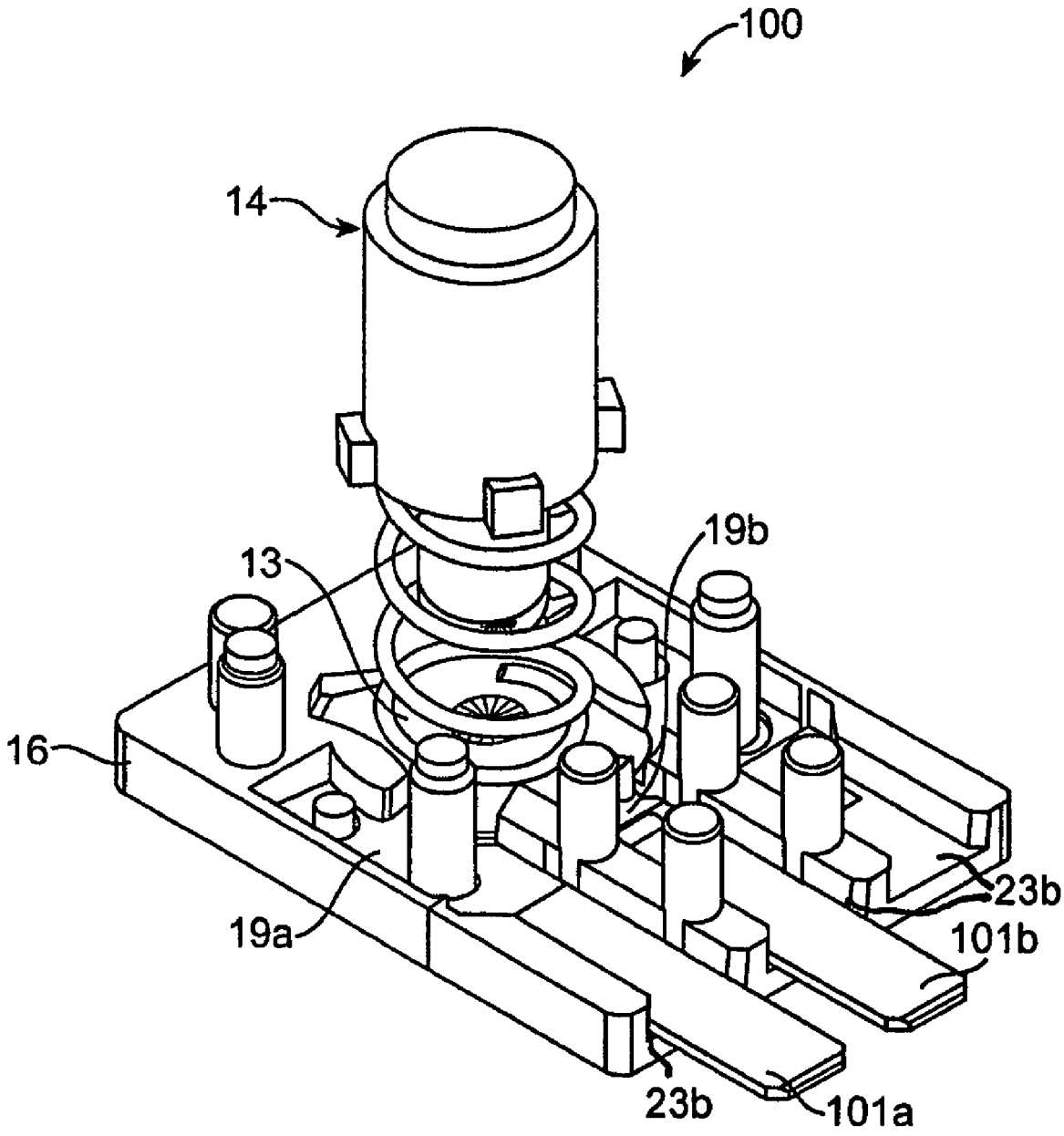
FIGS. 10A-10C show various embodiments of means for plugging the switch into an electrical system.
Figure 10B:
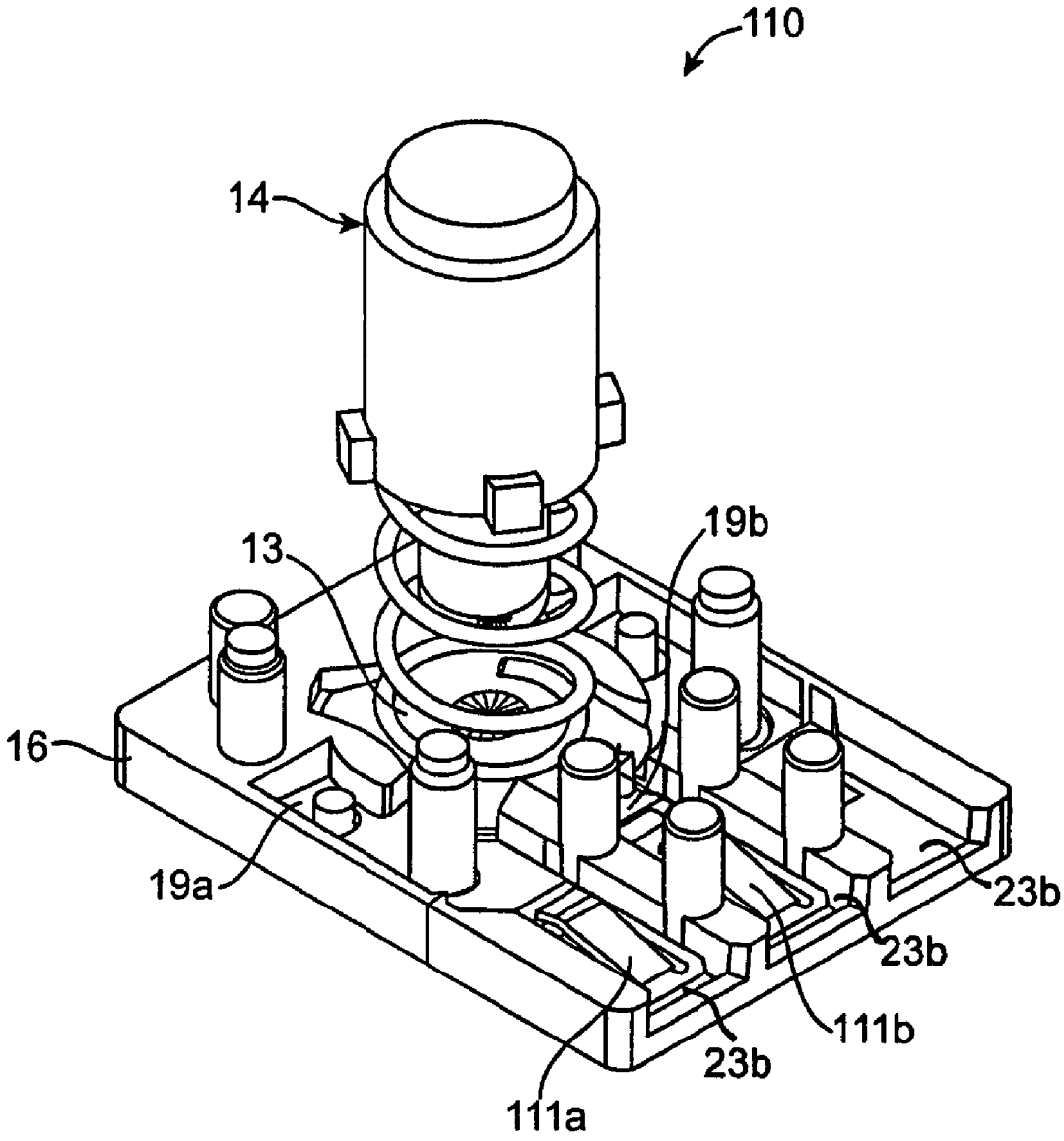
Figure 10C:
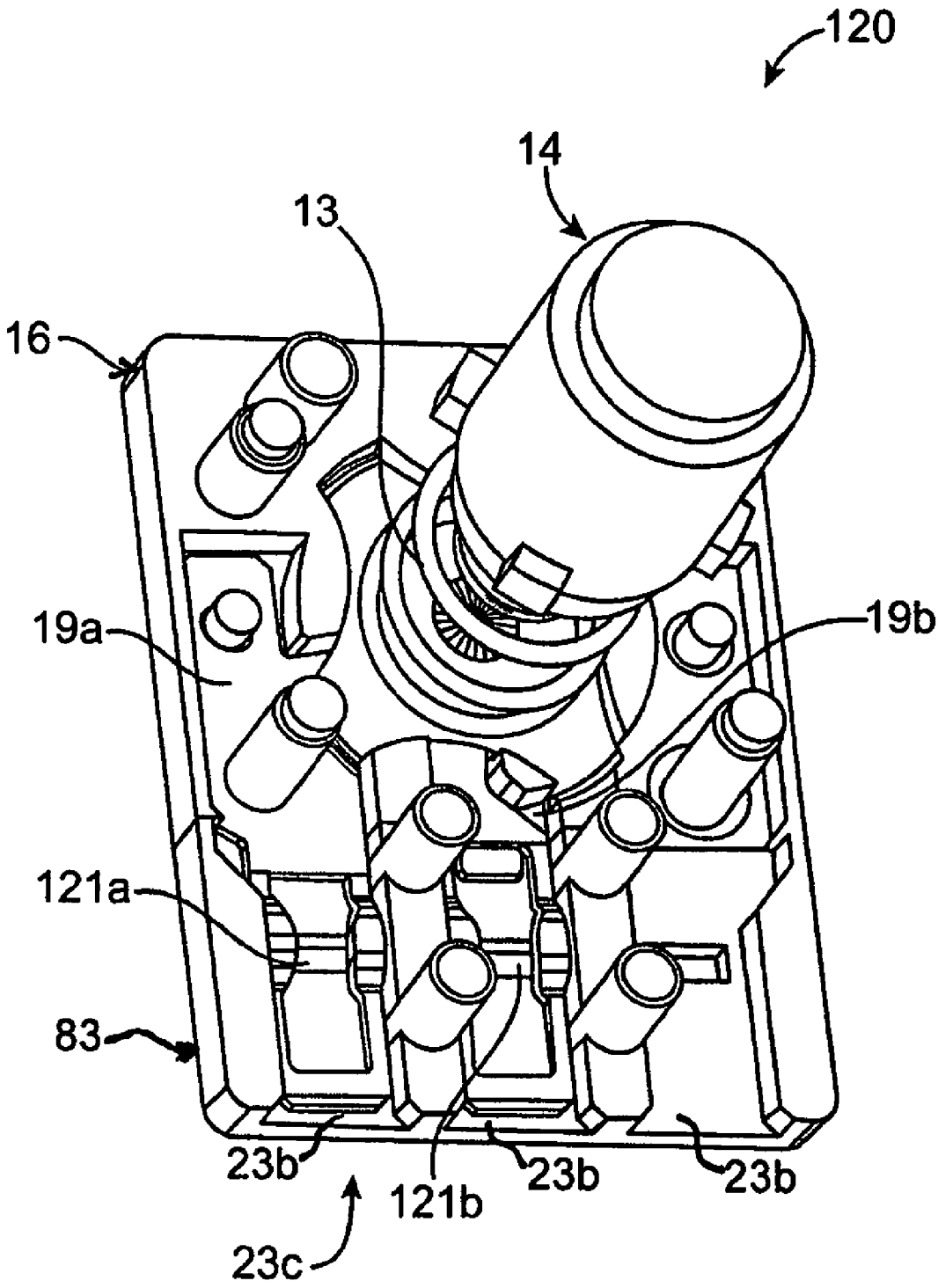

FIGS. 10A-10C show embodiments of means for connecting the switch into an electrical system. In FIG. 10A, the switch 100 has male terminals 101*a*, 101*b* in electrical contacts with terminals 19*a* and 19*b*, respectively. The male terminals 101*a*, 101*b* extend through cut-aways 23*b* on the cover 16. Accordingly, the switch 100 can be conveniently plugged into a socket in an electrical system. The switch 110 in FIG. 10B, on the other hand, has female terminals 111*a* and 111*b* for receiving male terminals through cut-aways 23*b* on the cover 16 from an electrical system. In the embodiment shown in FIG. 10C, the cover 16 of the switch 120 has apertures 121*a* and 121*b* on its bottom 83 for receiving electrical terminals for connection with terminals 19*a* and 19*b*. Thus, the switch 120 can be plugged in from the cover side through the bottom surface 83.

In addition, the cover 16 in FIG. 10C may also have cut-aways 23*b* on one end (edge or side) 23*c*, similar to the cut-aways 23*b* of the cover in FIG. 1A. A housing (not shown) may be used with the cover 16 in FIG. 10C, wherein the housing can be similar to the housing 18 in FIG. 1A and have corresponding cut-aways 23*a* similar to those of FIG. 1A, except that the cut-aways for the housing for the embodiment of FIG. 10C may be rectangular shaped to match the cut-aways 23*b* of the cover 16. The cutaways 23*b* and 23*a* in the side of the cover and housing for the switch 120 in FIG. 10C, respectively, form apertures (e.g., similar to apertures 23 in FIG. 2A) that allows the switch 120 to also receive electrical terminals from the end 23*c* of the switch 120.

Figure 11:
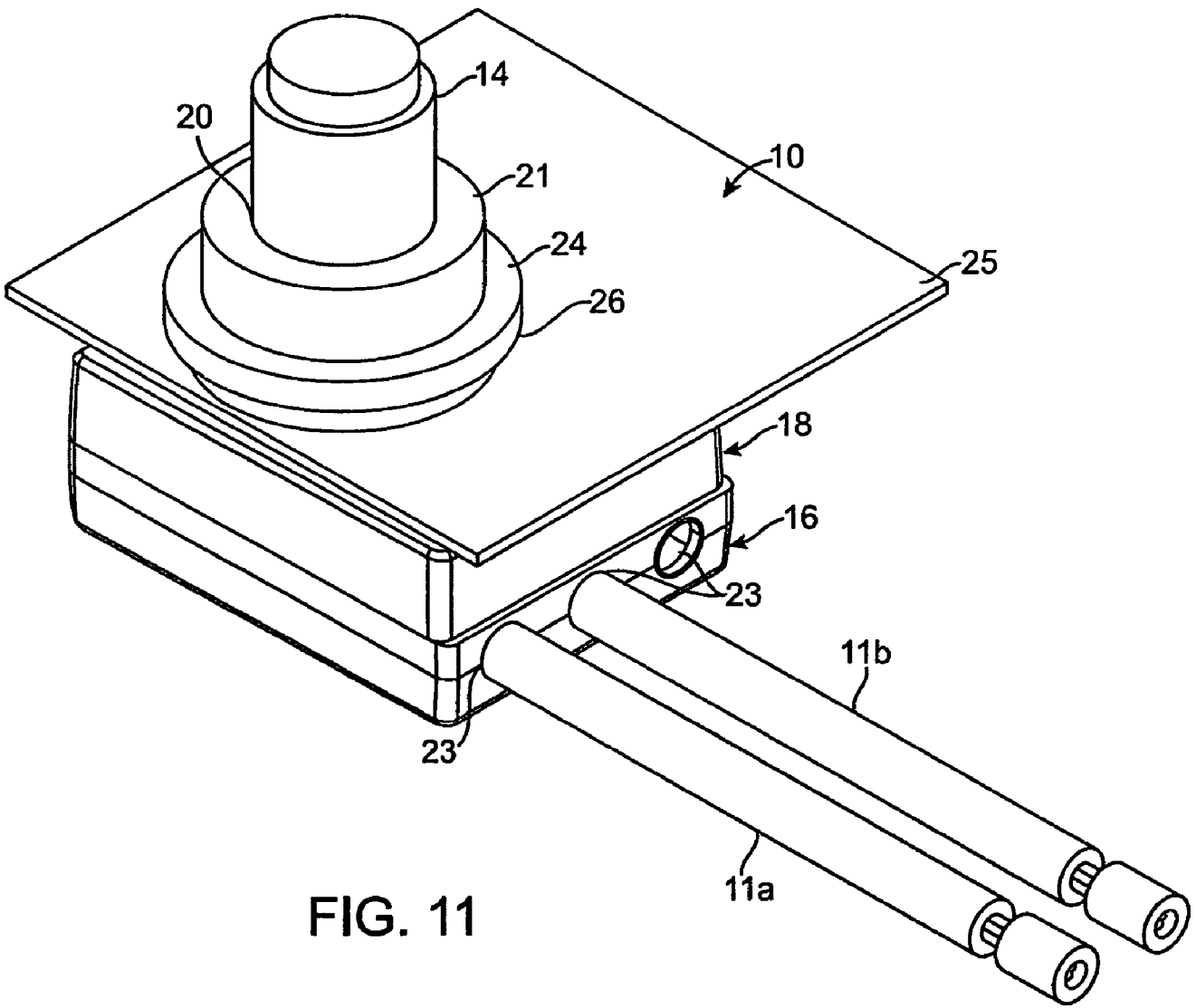
FIG. 11 shows a perspective view of an assembled electrical switch locked onto a panel in accordance with an embodiment of the invention.

FIG. 11 shows another perspective view of an assembled electrical switch in accordance with an embodiment of the invention. As shown the housing 18 further comprises a locking ring 24 around the guard ring 21, allowing the switch 10 to be installed on a panel or wall 25. This is realized by fitting a portion of the guard ring 21 through an aperture 26 in the panel or wall 25, and then locking the switch 10 onto the panel or wall 25 using the locking ring 24.

Figure 12:
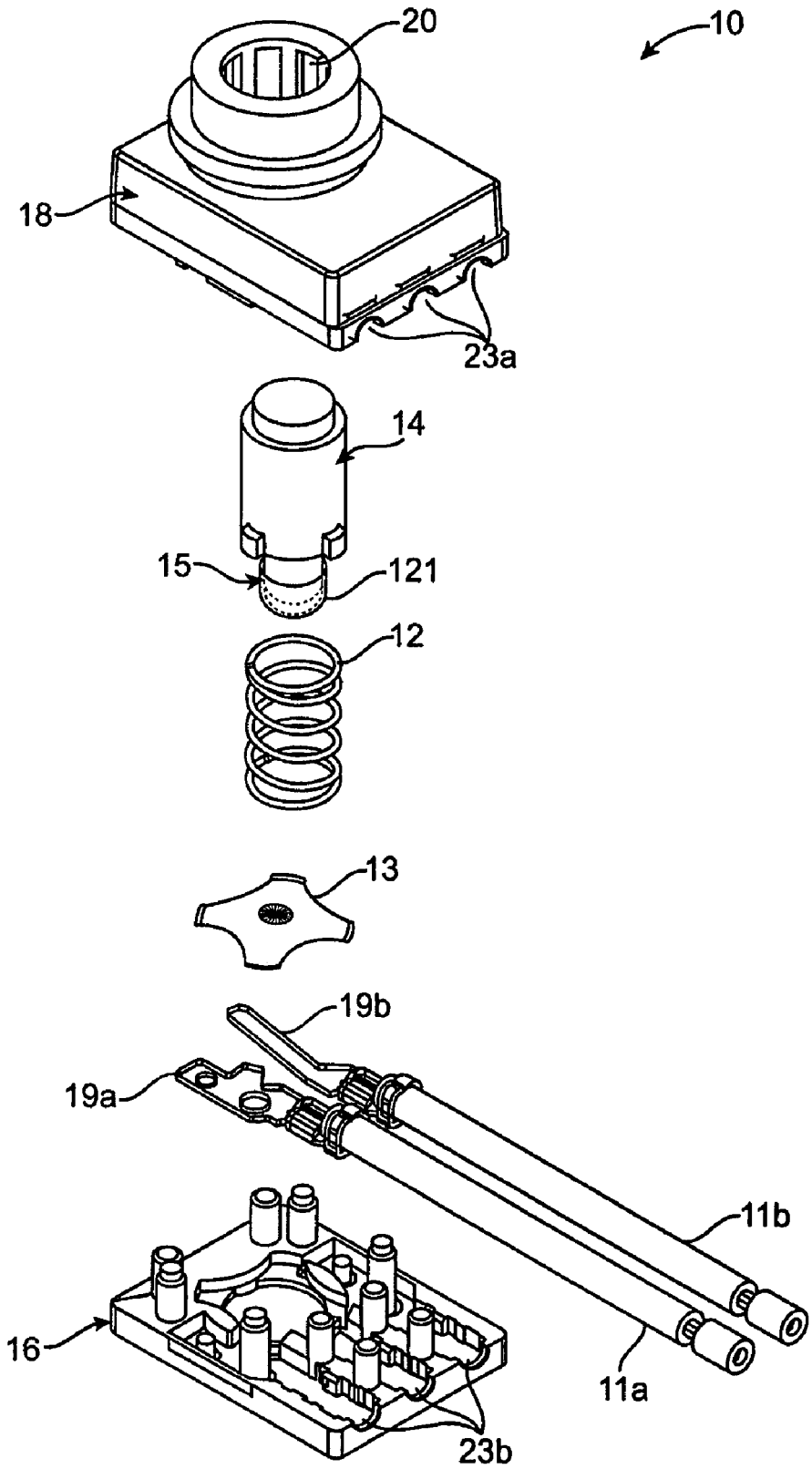
FIG. 12 shows an exploded view of the electrical switch assembly in accordance with an alternative embodiment of the invention.

FIG. 12 shows an embodiment of the switch 10 where the plunger portion 15 of the push button 14 is partially enclosed by a plunger cover 121. The plunger cover 121 is removably coupled to the push button 14 and is made of a material different from that of the push button 14. For example, the push button 14 including the plunger portion 15 may be made of a relatively stiff plastic material, while the plunger cover 121 may be made of a softer, resilient material such as rubber or silicone. By using a plunger cover 121 made with different materials and/or with different thicknesses, the pitch and duration of the audible feedback can be adjusted.

Those of ordinary skill in the art will recognize that the configurations of the recesses 81 in the housing 18 and the corresponding extrusions 61 of the cover 16 may be configured differently from the embodiments shown in the drawings. For example, recesses may be formed in the cover 16, or in both the housing 18 and the cover 16. Similarly, extrusions may be formed in either, or both, of the housing 18 and the cover 16. In addition, other types of coupling between the cover 16 and the housing 18 are possible. For example, a hinge between the cover 16 and the housing 18 may be used for easy access to the enclosure of the switch 10. Alternatively, glues or screws may be used to couple the cover 16 and the housing 18.

Advantageously, embodiments of the invention provide an electrical switch that has an audible feedback to the user substantially concurrently with making the electrical contact. Thus, the user is informed of the timing of the electrical contact. This is also useful when the user needs to count the number of clicks to be aware of the status of the switch, such as when different numbers/sound of clicks correspond to different positions of on/off and/or operation modes.

The present invention has been described in considerable detail with reference to certain preferred versions thereof; however, other versions are possible. Therefore, the spirit and scope of the appended claims should not be limited to the description of the preferred versions contained herein.

What is claimed is:

1. A switch apparatus, comprising: a compressible contact member; and a plunger for compressing the contact member, wherein the contact member creates a first audible feedback sound in response to being placed in a first electrical state when compressed by the plunger, such that in the first electrical state the contact member makes electrical contact with an electrical contact element of the switch, wherein the contact member creates said first audible feedback sound itself when at least a center portion of the contact member flexes due to a compression force, the contact member creates a second audible feedback sound itself in response to being placed in a second electrical state and a thickness and type of material of a plunger cover coupled to the plunger effects pitch and duration of the first feedback sound and the second feedback sound.

2. The switch apparatus of claim 1, wherein the contact member comprises a metal and makes direct electrical contact with an electrical contact element of the switch in the first electrical state.

3. The switch apparatus of claim 1, wherein the contact member has a dome shape including a plurality of legs.

4. The switch apparatus of claim 1, further comprising a plunger coupled to a push button, and a spring coupled to the plunger, wherein the spring forces the plunger to return to a first position when uncompressed.

5. The switch apparatus of claim 1, wherein the first audible feedback sound and the second audible feedback sound each have a different pitch.

6. The switch apparatus of claim 1, wherein the first audible feedback sound is made substantially concurrently as the contact member is placed in the first electrical state.

7. The switch apparatus of claim 1, wherein the time difference between the first audible feedback sound and the contact member being placed in the first electrical state is less than 0.3 milliseconds.

8. The switch apparatus of claim 1, wherein the contact member is compressible and has a normally domed shape, such that in response to a compression force the contact member deforms from said dome shape to a substantially flat shape thereby making said first audible feedback sound while, and in response to removal of the compression force the contact member returns from said flat shape to said dome shape thereby making said second audible feedback sound while being placed in the second electrical state.

9. The switch apparatus of claim 1, wherein the switch is a momentary push button switch.

10. A momentary switch system, comprising: a switch housing including a movable plunger portion; a compressible contact member disposed in the housing; and first and second electrical contact elements, wherein the contact member creates a first audible feedback sound itself in response to a compressing action of the plunger while being placed in a first electrical state making electrical contact with both the first and second electrical contact elements, wherein the contact member creates a second audible feedback sound itself in response to being placed in a second electrical state breaking electrical contact with at least one of the first and second electrical contact elements and a thickness, and type of material of a plunger cover coupled to the plunger effect pitch and duration of the first feedback sound and the second feedback sound.

11. The switch system of claim 10, wherein the first audible feedback sound and the second audible feedback sound each have a different pitch.

12. The switch system of claim 10, wherein the first audible feedback sound is made substantially concurrently as the contact member is placed in the first electrical state, and the second audible feedback sound is made substantially concurrently as the contact member is placed in the second electrical state.

13. The switch system of claim 10, wherein in response to the contact member being placed in the first electrical state, the first feedback sound is made in less than 0.3 milliseconds.

14. The switch system of claim 10, wherein in response to the contact member being placed in the first electrical state, the first feedback sound is made between the range of 0.1-0.29 milliseconds.

15. The switch system of claim 10, further comprising:

a push button coupled to the plunger, wherein the contact member comprises a metal and the push button operates to couple a portion of the contact member with the first and second electrical contact elements.

16. The switch system of claim 15, wherein a center portion of the contact member flexes a distance when compressed, to make contact with one of the electrical contact elements and breaks contact from said one of the electrical contact elements when uncompressed.

17. A switch apparatus, comprising: a compressible contact member; and a movable member, wherein the compressible contact member creates a first audible feedback sound itself in response to being placed in a compressed state by the moveable member such that the compressible contact member makes an electrical contact, and creates a second audible feedback sound in response to being uncompressed, the compressible contact member comprises a metal, and wherein a thickness and type of material of a plunger cover coupled to the plunger and a housing enclosing the contact member effect pitch and duration of the first feedback sound and the second feedback sound.

18. The switch apparatus of claim 17, wherein the compressible contact member includes at least one removable contact portion that makes an electrical contact when compressed.

19. The switch apparatus of claim 17, wherein the first audible feedback sound is made substantially concurrently as the compressible contact member is placed in a first electrical state making a direct electrical contact with an electrical element of the switch.

20. The switch apparatus of claim 19, wherein the second audible feedback sound is made substantially concurrently as the compressible contact member is placed in a second electrical state breaking a direct electrical contact.

21. The switch apparatus of claim 20, wherein the time difference between the first audible feedback sound and the contact member being placed in the first electrical state is less than about 0.3 milliseconds, and the time difference between the second audible feedback sound and the contact member being placed in the second electrical state is less than about 0.3 milliseconds.

* * * * *